US011271285B2

(12) United States Patent
Chen et al.

(10) Patent No.: US 11,271,285 B2
(45) Date of Patent: Mar. 8, 2022

(54) ANTENNA STRUCTURE

(71) Applicant: Shenzhen Next Generation Communications Limited, Shenzhen (CN)

(72) Inventors: Jia Chen, Shenzhen (CN); Kuo-Cheng Chen, New Taipei (TW); Jian-Wei Chang, New Taipei (TW); Zhen-Chang Tang, Shenzhen (CN); Bo Peng, Shenzhen (CN); Wei-Yu Ye, Shenzhen (CN); Chun-Sheng Wu, New Taipei (TW)

(73) Assignee: Mobile Drive Netherlands B.V., Amsterdam (NL)

( * ) Notice: Subject to any disclaimer, the term of this patent is extended or adjusted under 35 U.S.C. 154(b) by 88 days.

(21) Appl. No.: 16/568,981

(22) Filed: Sep. 12, 2019

(65) Prior Publication Data

US 2020/0091589 A1 Mar. 19, 2020

(30) Foreign Application Priority Data

Sep. 13, 2018 (CN) ..... 201811070579.3

(51) Int. Cl.

| | |
|---|---|
| ***H01Q 1/24*** | (2006.01) |
| ***H01Q 5/30*** | (2015.01) |
| ***H01Q 5/10*** | (2015.01) |
| ***H01Q 21/30*** | (2006.01) |
| ***H01Q 13/10*** | (2006.01) |

(52) U.S. Cl.

CPC ..... *H01Q 1/243* (2013.01); *H01Q 5/10* (2015.01); *H01Q 5/30* (2015.01); *H01Q 13/10* (2013.01); *H01Q 21/30* (2013.01)

(58) Field of Classification Search

CPC ..... H01Q 1/243; H01Q 5/30; H01Q 5/10; H01Q 13/10; H01Q 1/241; H01Q 1/242; H01Q 1/38; H01Q 13/22; H01Q 15/167; H01Q 21/30

See application file for complete search history.

(56) References Cited

U.S. PATENT DOCUMENTS

| | | | | |
|---|---|---|---|---|
| 10,498,041 | B1 * | 12/2019 | Lin | H01Q 13/18 |
| 2010/0156728 | A1 * | 6/2010 | Alvey | H01Q 13/10 343/702 |
| 2015/0236426 | A1 * | 8/2015 | Zhu | H01Q 1/2266 343/702 |
| 2017/0309993 | A1 * | 10/2017 | Tu | H01Q 13/10 |

FOREIGN PATENT DOCUMENTS

| | | |
|---|---|---|
| CN | 103545611 A | 1/2014 |
| CN | 107834171 | 3/2018 |
| CN | 108281753 A | 7/2018 |

* cited by examiner

*Primary Examiner* — Andrea Lindgren Baltzell
*Assistant Examiner* — Yonchan J Kim
(74) *Attorney, Agent, or Firm* — ScienBiziP, P.C.

(57) ABSTRACT

An antenna structure includes a metal frame. The metal frame includes a first surface, a second surface, and a third surface. The third surface is located between the first surface and the second surface. The metal frame includes at least one antenna. The at least one antenna includes a first gap, a second gap, and a feed portion. The first gap is disposed between the first surface and the second surface. The second gap is disposed in the third surface. The feed portion is mounted on the first surface and spans the first gap. When the feed portion supplies an electric current, the electric current is coupled to the first gap and the second gap.

20 Claims, 6 Drawing Sheets

ANTENNA STRUCTURE

FIELD

The subject matter herein generally relates to antenna structures, and more particularly to an antenna structure of a wireless communication device.

BACKGROUND

With the advancement of wireless communication technology, consumers have higher and higher requirements for the bandwidth of wireless communication products. Generally, a metal frame at upper and lower ends of a wireless communication device is used as an antenna. The metal frame is divided into several segments by setting a plurality of gaps in the metal frame for implementing antennas with different functions (for example, 4G Global Positioning System (GPS), and Wireless LAN (WLAN).

5G communication can add new communication frequency bands, but the original antenna space is already very crowded. If 5G antennas are added to the original antenna space, the performance of the original antenna may be affected, and a flexibility of antenna design may be reduced.

BRIEF DESCRIPTION OF THE DRAWINGS

Implementations of the present disclosure will now be described, by way of embodiments only, with reference to the attached figures.

DETAILED DESCRIPTION

Figure 1:
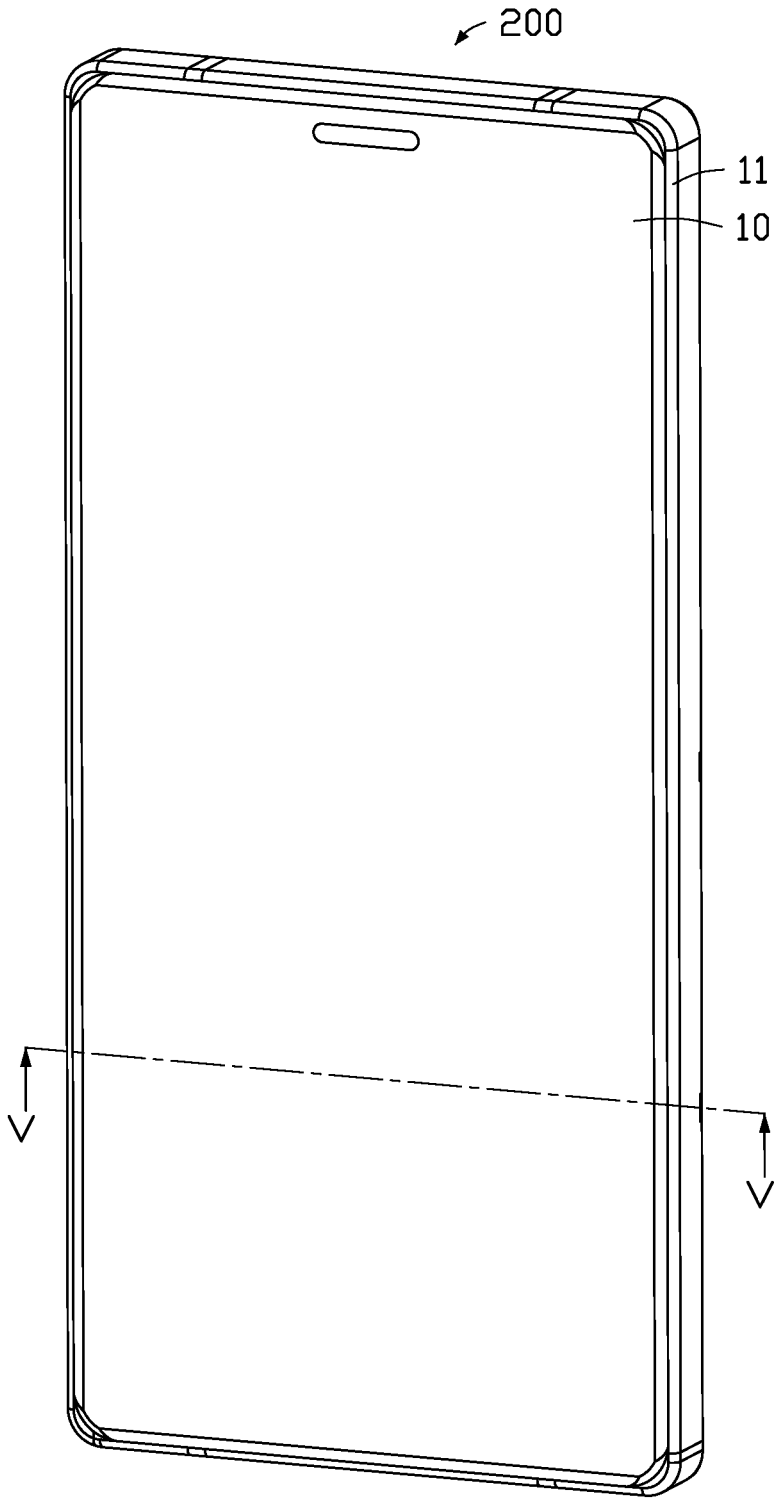
FIG. 1 is an isometric view of an embodiment of a wireless communication device including an antenna structure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
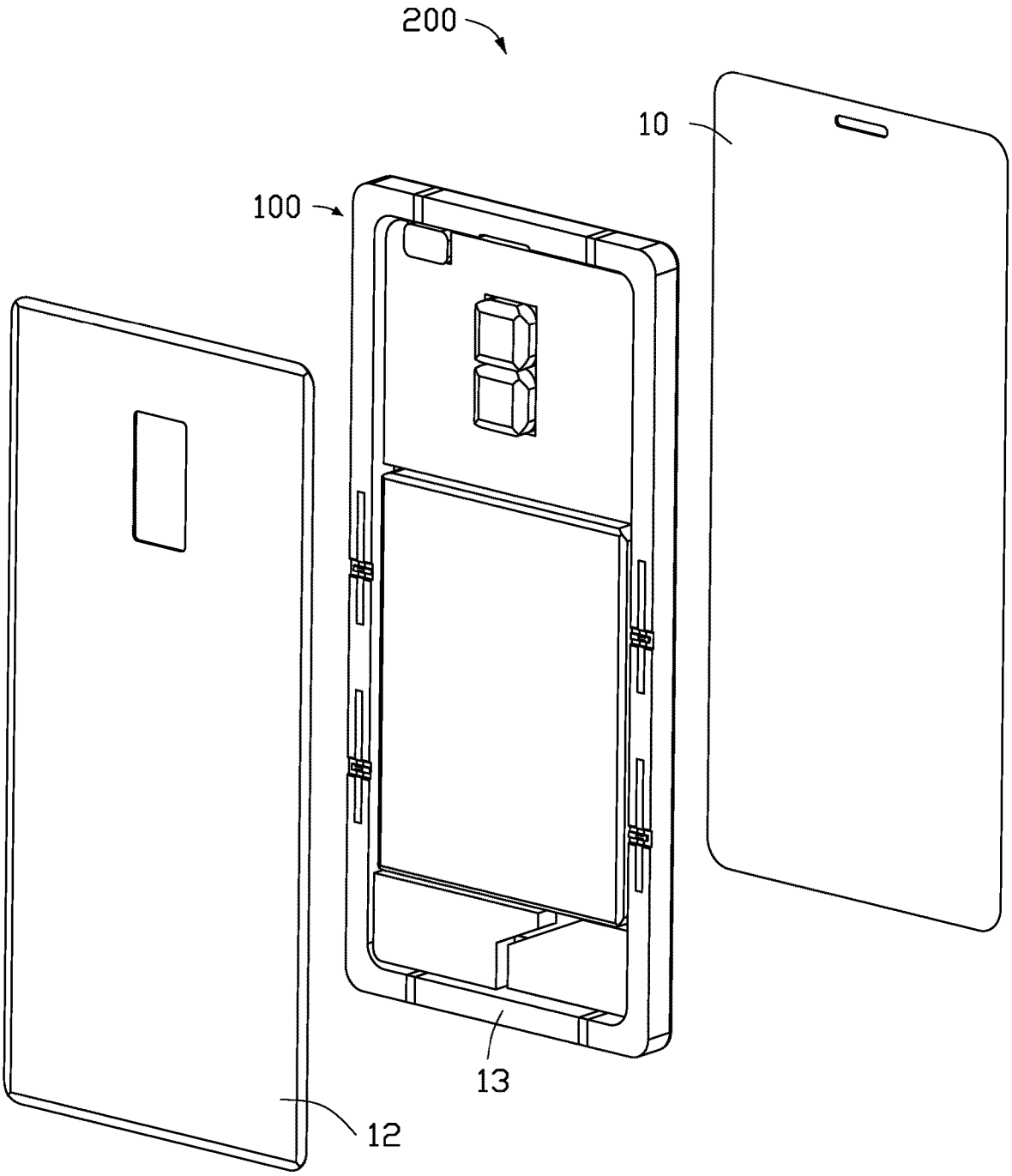
FIG. 2 is an exploded view of the wireless communication device in FIG. 1.

FIG. 1 and FIG. 2 show an embodiment of an antenna structure 100 applicable in a mobile phone, a personal digital assistant, or other wireless communication device 200 used for sending and receiving wireless signals.

The antenna structure 100 includes a housing 11. The housing 11 may be a housing of the wireless communication device 200. The housing 11 includes at least a backplane 12 and a metal frame 13. In one embodiment, the backplane 12 is made of a non-metallic material such as plastic, glass or ceramic. The metal frame 13 is made of a metal, and the metal frame 13 may be an outer frame of the wireless communication device 200. The backplane 12 and the metal frame 13 form an outer casing of the wireless communication device 200. The wireless communication device 200 also includes a display screen 10. In one embodiment, the display screen 10 can be a touch display screen, which can be used to provide an interactive interface to implement user interaction with the wireless communication device 200. The display screen 10 is substantially parallel to the backplane 12.

Figure 3:
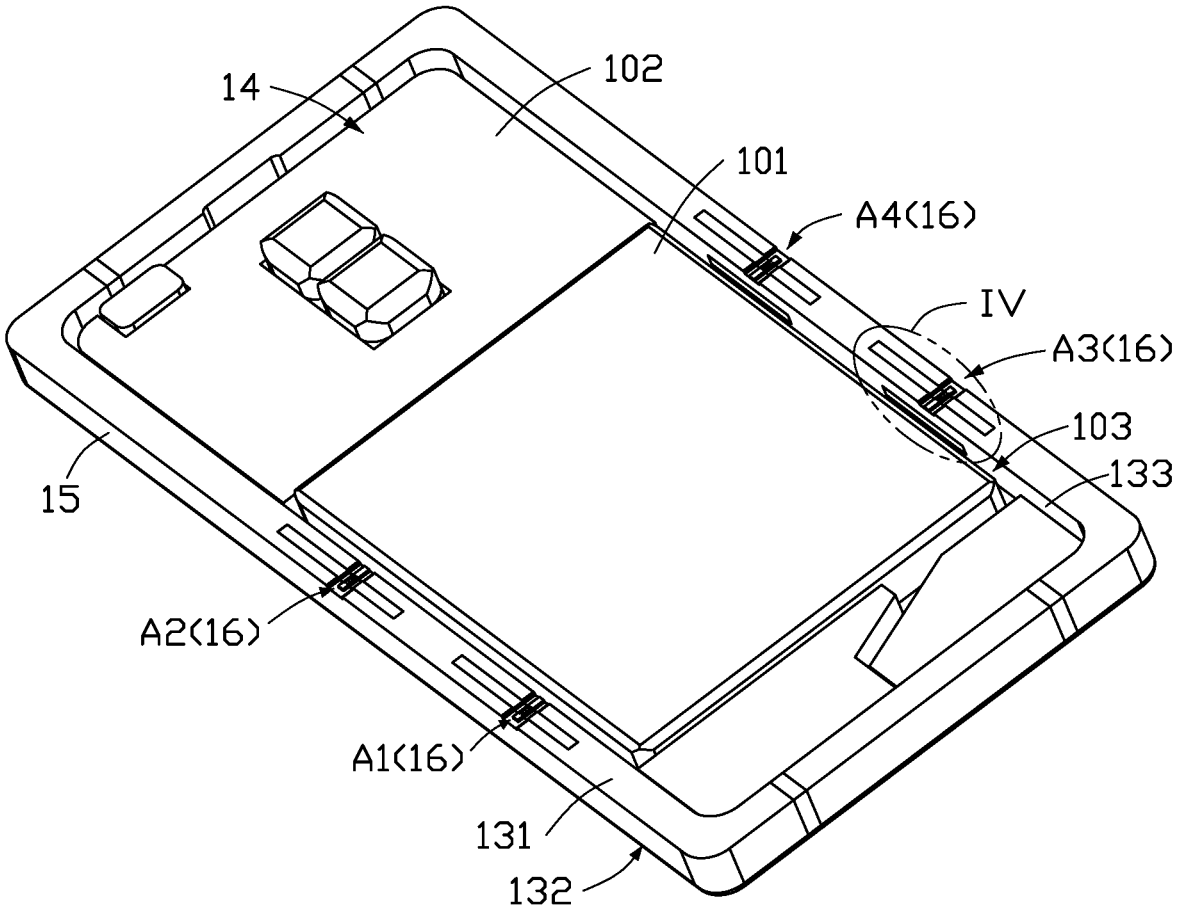
FIG. 3 is an isometric view of the antenna structure in FIG. 2.
Figure 4:
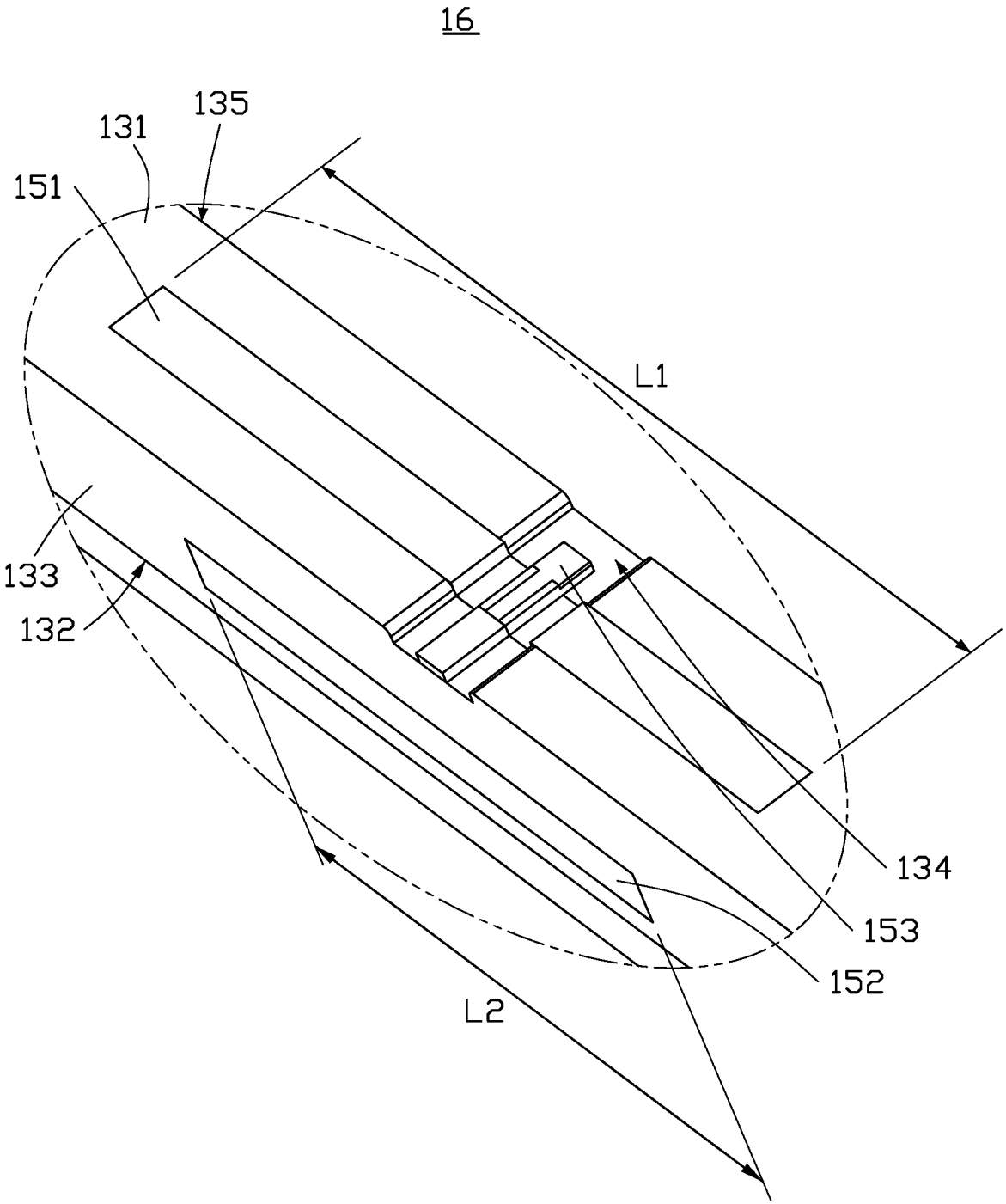
FIG. 4 is a close-up view of a portion of the antenna structure in FIG. 3.

As shown in FIG. 3 and FIG. 4, the metal frame 13 is substantially an annular structure. In one embodiment, the metal frame 13 and the backplane 12 enclose an accommodating space 14. The accommodating space 14 is used for accommodating electronic components or circuit modules of a battery 101, a main board 102, and a processing unit of the wireless communication device 200. The battery 101 is spaced from a sidewall of the metal frame 13, thereby forming a clearance area 103 of the antenna structure 100. The main board 102 can be a printed circuit board.

In one embodiment, the metal frame 13 includes four frames 15. Each of the frames 15 includes a first surface 131, a second surface 132, and a third surface 133. The second surface 132 is opposite to the first surface 131. The third surface 133 is located between the first surface 131 and the second surface 132. The first surface 131 is perpendicularly coupled to the third surface 133, and the second surface 132 is perpendicularly coupled to the third surface 133. The first surface 131 is parallel to and spaced from the second surface 132. In other embodiments, the third surface 133 may be coupled to the first surface 131 and the second surface 132 at different angles.

In one embodiment, the first surface 131 is adjacent to the backplane 12, and the second surface 132 is adjacent to the display screen 10. The third surface 133 faces an inner side of the metal frame 13. The first surface 131 defines a recessed portion 134. The recessed portion 134 is elongated and recessed from the first surface 131.

At least one antenna 16 is formed on the metal frame 13. In one embodiment, the at least one antenna 16 includes a first antenna A1, a second antenna A2, a third antenna A3, and a fourth antenna A4. The first antenna A1, the second antenna A2, the third antenna A3, and the fourth antenna A4 have a similar structure. The first antenna A1 and the second antenna A2 are located and spaced apart on one of the frames 15. The third antenna A3 and the fourth antenna A4 are located on another one of the frames 15 opposite to the first antenna A1 and the second antenna A2. The first antenna A1, the second antenna A2, the third antenna A3, and the fourth antenna A4 may form a multiple-input multiple-output (MIMO) antenna. In one embodiment, the first antenna A1, the second antenna A2, the third antenna A3, and the fourth antenna A4 provide 4×4 multiple inputs and multiple outputs.

In other embodiments, the first antenna A1, the second antenna A2, the third antenna A3, and the fourth antenna A4 are not limited to the foregoing configuration, and may be respectively mounted to the four frames 15 or may be mounted on three of the frames 15. In other words, the antenna 16 may be entirely mounted on one of the frames 15, mounted on some of the frames 15, or equally mounted on all of the frames 15. The number of antennas 16 on each of the frames 15 is not necessarily the same. The number of the antennas 16 formed on the metal frame 13 is not limited to four, and may be one or any number.

FIG. 4 illustrates one of the antennas 16 as described according to one embodiment. Each antenna 16 includes a first gap 151, a second gap 152, and a feed portion 153. The feed portion 153 is perpendicular to the first gap 151 and the second gap 152. The first gap 151 is disposed between the first surface 131 and the second surface 132. The second gap 152 is disposed in the third surface 133. The feed portion 153 is mounted in the recessed portion 134. The feed portion 153 is located on the first surface 131 and spans the first gap 151. The recessed portion 134 receives the feed portion 153.

Figure 5:
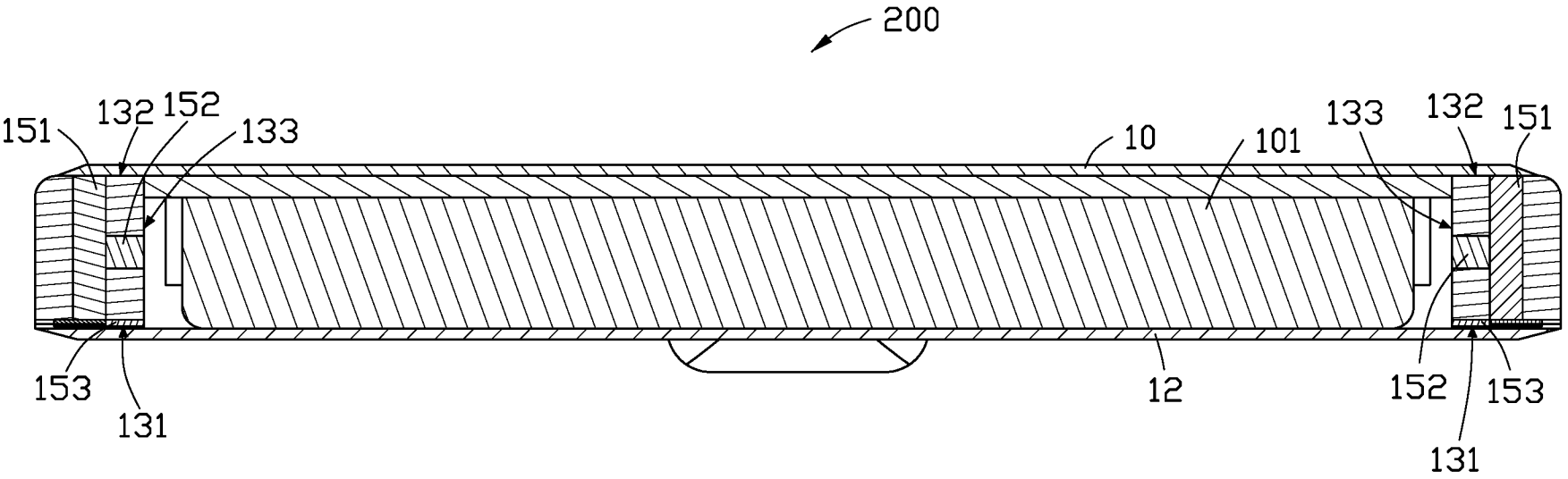
FIG. 5 is a cross-sectional view taken along line V-V in FIG. 1.

As shown in FIG. 5, the first gap 151 and the second gap 152 are perpendicularly coupled such that the first gap 151 and the second gap 152 have a T-shaped cross-section.

In one embodiment, the first gap 151, the second gap 152, and the feed portion 153 are elongated in shape. The first gap 151 and the second gap 152 may or may not be filled with an insulating material. The feed portion 153 can be a wire, such as a wire of a metal segment on a flexible printed circuit board.

In another embodiment, the first surface 131 is adjacent to the backplane 12, and the second surface 132 is adjacent to the display screen 10. The first surface 131 is a smooth surface and does not define the recessed portion 134. Instead, the recessed portion 134 is defined in the backplane 12 adjacent to the first surface 131. Thus, the feed portion 153 is mounted on the first surface 131 and is received in the recessed portion 134 of the backplane 12.

In a third embodiment, the first surface 131 is adjacent to the display screen 10, and the second surface 132 is adjacent to the backplane 12. The first surface 131 defines the recessed portion 134, and the feed portion 153 is received in the recessed portion 134 of the first surface 131.

In a fourth embodiment, the first surface 131 is adjacent to the display screen 10, and the second surface 132 is adjacent to the backplane 12. The first surface 131 is a smooth surface and does not define the recessed portion 134. Instead, the recessed portion 134 is defined in the display screen 10 adjacent to the first surface 131. The feed portion 153 is mounted on the first surface 131 and received in the recessed portion of the display screen 10.

In one embodiment, the third surface 133 faces an inner side of the metal frame 13, and the second gap 152 passes through the first gap 151 and the third surface 133. In other embodiments, the third surface 133 faces an outer side of the metal frame 13, such that the third surface 133 is a portion of the outer surface 135 of the wireless communication device 200. Thus, the second gap 152 passes through the first gap 151 and the third surface 133 (the outer surface 135).

FIG. 4 shows, a first length L1 of the first gap 151 is different from a second length L2 of the second gap 152 in one embodiment. The first length L1 of the first gap 151 is greater than the second length L2 of the second gap 152. The first length L1 of the first gap 151 and the second length L2 of the second gap 152 both extend along the frame 15 where the first gap 151 and the second gap 152 are defined. The first length L1 of the first gap 151 and the second length L2 of the second gap 152 are smaller than a length of the frame 15 where the first gap 151 and the second gap 152 are respectively defined.

In other embodiments, the first length L1 of the first gap 151 may be shorter than the second length L2 of the second gap 152. The first length L1 of the first gap 151 and the second length L2 of the second gap 152 can be adjusted according to requirements.

When the feed portion 153 supplies an electric current, the electric current is coupled to the first gap 151 and the second gap 152 such that the first gap 151 and the second gap 152 respectively excite a first resonance mode and a second resonance mode and generate a radiation signal in a first frequency band and a second frequency band, respectively.

In one embodiment, the first resonance mode and the second resonance mode are both 5G sub-6 GHz modes. The second frequency band is higher than the first frequency band. The first frequency band is 3.3 to 3.6 GHz, and the second frequency band is 4.8 to 5.0 GHz.

Figure 6:
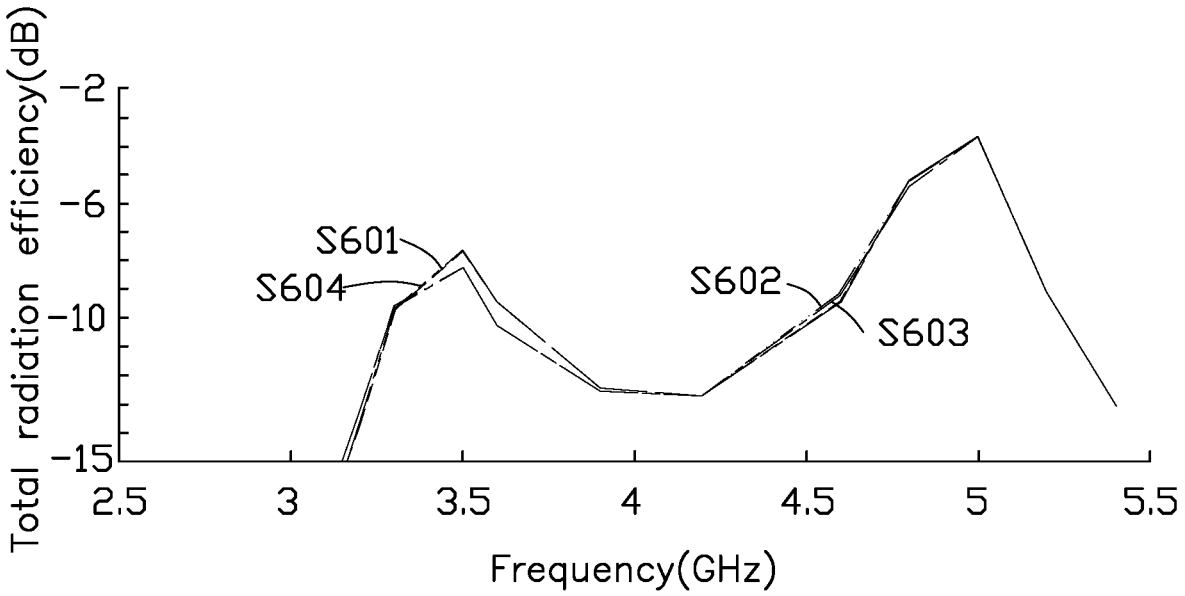
FIG. 6 is a graph of total radiation efficiency of the antenna structure.

FIG. 6 shows a graph of total radiation efficiency of the antenna structure 100. A plotline S601 is a total radiation efficiency of the first antenna A1. A plotline S602 is a graph of total radiation efficiency of the second antenna A2. A plotline S603 is a graph of total radiation efficiency of the third antenna A3. A plotline S604 is a graph of total radiation efficiency of the fourth antenna A4. It can be seen that the plotline S601 of the total radiation efficiency of the first antenna A1 and the plotline S604 of the total radiation efficiency of the fourth antenna A4 substantially coincide, and the plotline S603 of the total radiation efficiency of the second antenna A2 and the plotline S603 of the total radiation efficiency of the third antenna A3 substantially coincide. The total radiation efficiencies of the plurality of antennas 16 disposed on the same side of the metal frame 13 are substantially the same.

As described in the foregoing embodiments, the antenna structure 100 includes at least one antenna 16 mounted on the metal frame 13. Each of the antennas 16 includes a first gap 151, a second gap 152, and a feed portion 153. The first gap 151 passes through the first surface 131 and the second surface 132 of the metal frame 13. The second gap 152 passes through the first gap 151 and the third surface 133 of the metal frame 13. The feed portion 153 spans the first gap 151 and supplies an electric current into the first gap 151 and the second gap 152 in a coupled manner such that the first gap 151 and the second gap 152 respectively excite the first resonance mode and the second resonance mode are generate the radiation signals in the 3.3-3.6 GHz frequency band and the 4.8-5.0 GHz frequency band, respectively. Therefore, the wireless communication device 200 can increase the transmission bandwidth by adding a 5G sub-6 GHz antenna while maintaining the performance of the original antenna.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure applied in a wireless communication device, the antenna structure comprising:

a metal frame comprising a first surface, a second surface, and a third surface;

wherein:

the third surface is located between the first surface and the second surface;

the metal frame comprises at least one antenna;

the at least one antenna comprises a first gap, a second gap, and a feed portion;

the first gap is disposed on the first surface and extends to and across the second surface;

the second gap is disposed in the third surface and communicates with the first gap; and the feed portion is mounted on the first surface and spans the first gap, the feed portion is received in a recessed portion defined in the first surface, a backplane, or a display of the wireless communication, wherein when the feed portion supplies an electric current, the electric current is coupled to the first gap and the second gap.

2. The antenna structure of claim 1, wherein:

the first surface is perpendicularly coupled to the third surface;

the second surface is perpendicularly coupled to the third surface; and the first surface is parallel to and spaced from the second surface.

3. The antenna structure of claim 1, wherein:

the first gap is perpendicularly coupled to the second gap; and a cross-section of the first gap and the second gap is T-shaped.

4. The antenna structure of claim 1, wherein:

the first gap, the second gap, and the feed portion are elongated in shape; and the feed portion is perpendicular to the first gap and the second gap.

5. The antenna structure of claim 1, wherein the third surface faces an inner side of the metal frame.

6. The antenna structure of claim 1, wherein the third surface faces an outer side of the metal frame.

7. The antenna structure of claim 6, wherein the third surface is a portion of an outer surface of the wireless communication device.

8. The antenna structure of claim 1, wherein:

a length of the first gap is longer than a length of the second gap, wherein when the feed portion supplies an electric current, the electric current from the feed portion is coupled to the first gap and the second gap to excite a first resonance mode and a second resonance mode and respectively generate radiation signals in a first frequency band and a second frequency band.

9. The antenna structure of claim 8, wherein the second frequency band is higher than the first frequency band.

10. A wireless communication device comprising an antenna structure, the antenna structure comprising:

a metal frame comprising a first surface, a second surface, and a third surface;

wherein:

the third surface is located between the first surface and the second surface;

the metal frame comprises at least one antenna;

the at least one antenna comprises a first gap, a second gap, and a feed portion;

the first gap is disposed on the first surface and extends to and across the second surface;

the second gap is disposed in the third surface and communicates with the first gap; and the feed portion is mounted on the first surface and spans the first gap, the feed portion is received in a recessed portion defined in the first surface, a backplane, or a display of the wireless communication, wherein when the feed portion supplies an electric current, the electric current is coupled to the first gap and the second gap.

11. The wireless communication device of claim 10, wherein:

the first surface is perpendicularly coupled to the third surface;

the second surface is perpendicularly coupled to the third surface; and the first surface is parallel to and spaced from the second surface.

12. The wireless communication device of claim 10, wherein:

the first gap is perpendicularly coupled to the second gap; and a cross-section of the first gap and the second gap is T-shaped.

13. The wireless communication device of claim 10, wherein:

the first gap, the second gap, and the feed portion are strip-shaped; and the feed portion is perpendicular to the first gap and the second gap.

14. The wireless communication device of claim 10, wherein the third surface faces an inner side of the metal frame.

15. The wireless communication device of claim 10, wherein the third surface faces an outer side of the metal frame.

16. The wireless communication device of claim 15, wherein the third surface is a portion of an outer surface of the wireless communication device.

17. The wireless communication device of claim 10, wherein:

a length of the first gap is longer than a length of the second gap, wherein when the feed portion supplies an electric current, the electric current from the feed portion is coupled to the first gap and the second gap to excite a first resonance mode and a second resonance mode and respectively generate radiation signals in a first frequency band and a second frequency band.

18. The wireless communication device of claim 17, wherein the second frequency band is higher than the first frequency band.

19. The wireless communication device of claim 10 further comprising the backplane and the display screen, wherein:

the first surface is adjacent to the backplane, and the second surface is adjacent to the display screen.

20. The wireless communication device of claim 10 further comprising the backplane and the display screen, wherein:

the first surface is adjacent to the display screen, and the second surface is adjacent to the backplane.

* * * * *